US009774962B2

(12) United States Patent
Karamuk et al.

(10) Patent No.: US 9,774,962 B2
(45) Date of Patent: Sep. 26, 2017

(54) SHELL FOR A HEARING DEVICE

(71) Applicant: Sonova AG, Staefa (CH)

(72) Inventors: Erdal Karamuk, Männedorf (CH); Matthias Stadler, Männedorf (CH); Thomas Winkler, Rapperswil (CH); Markus Mueller, Männedorf (CH); Daniel Probst, Uerikon (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 14/758,606

(22) PCT Filed: Jan. 11, 2013

(86) PCT No.: PCT/EP2013/050456

§ 371 (c)(1),
(2) Date: Jun. 30, 2015

(87) PCT Pub. No.: WO2014/108200

PCT Pub. Date: Jul. 17, 2014

(65) Prior Publication Data

US 2015/0358749 A1 Dec. 10, 2015

(51) Int. Cl.
*H04R 25/00* (2006.01)

(52) U.S. Cl.
CPC ..... *H04R 25/65* (2013.01); *H04R 25/652* (2013.01); *H04R 25/658* (2013.01); *H04R 2225/021* (2013.01); *H04R 2225/023* (2013.01); *H04R 2225/77* (2013.01)

(58) Field of Classification Search
CPC .. H04R 1/1016; H04R 25/652; H04R 25/654; H04R 25/658; H04R 2225/023; H04R 2225/025; H04R 2460/15; H04R 25/65
See application file for complete search history.

(56) References Cited

U.S. PATENT DOCUMENTS

| | | | | |
|---|---|---|---|---|
| 6,533,062 | B1 * | 3/2003 | Widmer | H04R 25/658 181/129 |
| 7,130,437 | B2 | 10/2006 | Stonikas et al. | |
| 2002/0025055 | A1 * | 2/2002 | Stonikas | H04R 25/652 381/322 |
| 2012/0020507 | A1 | 1/2012 | Hies et al. | |
| 2012/0269955 | A1 | 10/2012 | Bleuer | |

FOREIGN PATENT DOCUMENTS

| | | |
|---|---|---|
| DE | 10 2011 080767 | 12/2012 |
| GB | 1596369 A | 8/1981 |
| WO | WO 2009/138895 A1 | 11/2009 |

OTHER PUBLICATIONS

PCT Search Report dated Sep. 20, 2013 for PCT App. Ser. No. PCT/EP2013/050456.

* cited by examiner

*Primary Examiner* — Joshua Kaufman
(74) *Attorney, Agent, or Firm* — Henricks, Slavin & Holmes LLP

(57) ABSTRACT

A shell (10) for a hearing device, and a method of producing the same. The shell (10) comprises a sub-shell (11) produced by a generative method, and a thermoformed hull (12) covering the subshell (11). The sub-shell (11) comprises lateral openings (13) covered by the thermoformed hull (12) so as to render the shell (10) more flexible in the region of the openings (13), and thereby to relieve pressure exerted by the shell (10) due to dynamic changes in the shape of the wearer's ear canal during jaw movement.

21 Claims, 7 Drawing Sheets

SHELL FOR A HEARING DEVICE

CROSS-REFERENCE TO RELATED APPLICATIONS

This application is the U.S. National Stage of PCT App. Ser. No. PCT/EP2013/050456, filed Jan. 11, 2013.

TECHNICAL FIELD OF THE INVENTION

The present invention relates to shells for hearing devices. Hearing devices include hearing aids for the hard of hearing, communication devices, and active hearing protection for loud noises. They are at least partially positioned in the wearer's ear to varying degrees, and may incorporate a behind-the-ear unit situated behind the wearer's pinna and connected either acoustically or electrically with an earpiece.

BACKGROUND OF THE INVENTION

Currently, shells for hearing devices, that is to say the outer shell of an In-the-Ear hearing device or the shell of an earpiece of a Behind-The-Ear hearing device, are in general constructed as a hard shell shaped according to an impression or scan taken of the individual's unique ear canal in a static jaw position. Since the shape of the ear canal varies during normal jaw movement e.g. when talking or chewing, pressure can be exerted by the hard shell of the hearing device on the ear canal, leading to discomfort, sound leakage during jaw movement, and possible generation of disturbing noises when speaking or eating. Furthermore, the hearing device or earpiece may also migrate out of the wearer's ear due to these dynamic changes in ear canal geometry.

Various prior art attempts to mitigate these problems have been disclosed in U.S. Pat. No. 7,720,242, US 2004/0252854 and U.S. Pat. No. 7,130,437, however the resulting hearing devices are somewhat bulky and are thus little suited for modern so-called "Invisible In the Canal (iiC)" applications, which are inserted deep into the ear canal and extending into the bony region, and therefore require a high level of miniaturisation.

The aim of the present invention is thus to overcome at least some of the disadvantages of the prior art.

SUMMARY OF THE INVENTION

The object of the invention is attained by a shell for a hearing device, which comprises a sub-shell comprising one or more lateral openings, and a thermoformed hull attached to the subshell and covering the one or more lateral openings. "Lateral" should be understood as "sideways" or "transverse", i.e. the opening(s) is/are situated in the side of the sub-shell, a normal to a plane tangential to the centroid of the opening being at an angle to the major axis of the sub-shell. Particularly, this angle is greater than 30°.

In consequence, in the region of the lateral opening or openings, the local rigidity of the shell is reduced, since the local rigidity is only that of the thermoformed hull. On the remainder of the shell, the rigidity is that of the sum of the rigidities of the sub-shell and of the thermoformed hull. In consequence, the local rigidity can be substantially reduced in comparison to single-piece and/or single-material shells e.g. in the regions of the shell subject to pressure from the ear canal during dynamic movement thereof, such as during chewing, talking etc. Due to this reduction in local rigidity, the local flexibility is likewise increased, permitting the shell to flex and deform in response to ear canal movement, reducing discomfort for the wearer. In dimensional terms, the total thickness of the shell can be reduced to 0.1 mm or less, or even down to 20 μm, in the region of the openings in the sub-shell, while the total thickness of the shell can remain at 0.4 mm or greater outside of the region of the openings in the sub-shell, ensuring that the shell as a whole exhibits sufficient rigidity and mechanical stability. With current manufacturing techniques, this is not achievable with a single-piece and/or single-material shell.

In an embodiment, the sub-shell is more rigid than the thermoformed hull, ensuring that the shell as a whole exhibits sufficient resistance to excessive longitudinal deformation of the shell.

In an embodiment, the at least one lateral opening is situated at a location on the sub-shell destined to be subject to pressure due to dynamic changes in the shape of the ear canal of the wearer e.g. during normal jaw movement, the opening or openings being shaped so as to permit the thermoformed hull to flex in response to this pressure. Thus, the wearer's comfort is enhanced.

In an embodiment, the at least one lateral opening comprises at least two lateral openings situated in substantially opposite side of the sub-shell, i.e. substantially facing each other across the interior cavity of the shell. This optimises the location of the less rigid, more flexible shell regions to better respond to changes in the shape of the wearer's ear canal.

In an embodiment, the shell comprises a vent channel formed between the thermoformed hull and the groove provided in the sub-shell. This eliminates the requirement for a separate vent tube passing through the interior of the shell, saving space in the interior of the shell for electronic components. Furthermore, since this vent channel is closed along its length and just open at its extremities, it is less susceptible to cerumen buildup than for instance an open vent channel or groove formed in the outer surface of the shell. Additionally, forming the vent channel by a groove in the sub-shell on the one side and the thermoformed hull on the other side, construction is easier than closed channels formed in the wall thickness of a single-piece shell.

In an embodiment, the sub-shell is situated on the interior of the thermoformed hull, giving a continuous, smooth outer surface to the shell and allowing the openings in the sub-shell to free up space on the interior of the shell for placement of electronic components.

In an alternative embodiment, the sub-shell is situated on the exterior of the thermoformed hull, protecting the bulk of the thermoformed hull from damage.

In an embodiment, the thermoformed hull is made of PE (Polyethylene), BAREX (Acrylonitrile/Methyl acrylate), PET (Polyethylene Terephthalate), COP (Cyclo Olefin Polymer), PCTFE (Polychlortrifluorethylene), EVA (Ethylene-vinyl acetate) or PEEK (Polyetheretherketone). These materials are all thermoformable materials with the requisite properties, for instance tensile strength, moisture barrier properties, chemical resistance, and biocompatibility. The sub-shell is constructed of a polymer material or a ceramic-filled polymer material such as UV- or visible light cured acrylic resins which are already used for the generative/additive manufacturing of hearing aid shells. Alternatively, the sub-shell can also be made of a sintered thermoplastic polymer powder (e.g. polyamide PA12). These materials are suitable for use with generative manufacturing methods, have the requisite stiffness and strength, chemical resistance and are biocompatible.

The object of the invention is likewise attained by a hearing device comprising a shell as described above.

Furthermore, the object of the invention is attained by a method of manufacturing a shell for a hearing device. This method comprises manufacturing a sub-shell which comprises at least one lateral opening. A thermoformed hull conformed to fit the sub-shell is formed, either separately, or in situ, and the hull is attached to the sub-shell so that the thermoformed hull covers the at least one lateral opening. The attachment may take place by forming the thermoformed hull and the sub-shell integrally, or may take place separately e.g. by adhesive bonding, ultrasonic welding, or similar.

Thereby, a shell for a hearing device is formed in which, in the region of the lateral opening or openings, the local rigidity of the shell is reduced, since the local rigidity is only that of the thermoformed hull. On the remainder of the shell, the rigidity is that of the sum of the rigidities of the sub-shell and of the thermoformed hull. In consequence, the local rigidity of the shell can be substantially reduced e.g. in the regions of the shell subject to pressure from the ear canal during dynamic movement thereof, such as during chewing, talking etc. Due to this reduction in local rigidity, the local flexibility is likewise increased, permitting the shell to flex and deform in response to ear canal movement, reducing discomfort for the wearer. In dimensional terms, the total thickness of the shell can be reduced to 0.1 mm or less, or even down to 20 μm, in the region of the openings in the sub-shell, while the total thickness of the shell can remain at 0.4 mm or greater outside of the region of the openings in the sub-shell, ensuring that the shell as a whole exhibits sufficient rigidity and mechanical stability. With current manufacturing techniques, this is not achievable with a single-piece shell formed by injection moulding, or by generative manufacturing methods.

In an embodiment of the method, the hull is formed by taking at least two measurements of an ear canal of a patient e.g. at different jaw positions, and then fabricating a thermoforming die based at least partially on these measurements, e.g. by computer modelling of an optimal shell form and deriving from this modelling the required shape of the thermoformed hull. Subsequently, the thermoformed hull is thermoformed by means of the thermoforming die. Thus, a precise, custom-shaped thermoformed hull is created.

In an embodiment of the method, the thermoforming die is formed by a generative manufacturing process such as laser sintering, laser lithography, stereolithography, or a thermojet process. This enables cost-effective manufacturing of a custom thermoforming die.

In an embodiment of the method, the sub-shell is formed by modification of the thermoforming die after thermoforming of the thermoformed hull. This removes the necessity to manufacture the sub-shell separately, keeping production costs low, and, since the sub-shell is made from the thermoforming die, the fit between the sub-shell and the thermoformed hull is extremely precise. Furthermore, by means of this method, the sub-shell and the thermoformed hull may be formed integrally with each other. In a further embodiment of the method, the hull is attached to the thermoforming die during the step of thermoforming of the thermoformed hull, and the step of forming the sub-shell comprises removing portions of the thermoforming die, such as weakened break-away "windows", to form the sub-shell. This speeds up the process of converting the thermoforming die to the sub-shell, since such easily-removable portions can be removed with little effort.

In an alternative embodiment of the method, the thermoforming die is constituted at least partially by the sub-shell. This has the advantage that no separate thermoforming die need be produced, keeping costs low and ensuring excellent fit between the thermoformed hull and the sub-shell. Furthermore, by means of this method, the sub-shell and the thermoformed hull may be formed integrally with each other.

In an embodiment of the method, the sub-shell is formed by taking at least two measurements of an ear canal of a patient e.g at different jaw positions, then, based at least partially on these measurements, e.g. by computer modelling of an optimal shell form and deriving from this modelling the required shape of the sub-shell, forming the sub-shell by means of a generative manufacturing process such as laser sintering, laser lithography, stereolithography, or a thermojet process. This enables cost-effective manufacturing of a sub-shell.

In an embodiment of the method, the thermoformed hull is attached on the exterior of the sub-shell, giving a continuous, smooth outer surface to the shell and allowing the openings in the sub-shell to free up space on the interior of the shell for placement of electronic components. Alternatively, the thermoformed hull is attached on the interior of the sub-shell, leaving the sub-shell exposed and thereby protecting the bulk of the thermoformed hull from damage.

In an embodiment of the method, the thermoformed hull is made of PE (Polyethylene), BAREX (Acrylonitrile/Methyl acrylate), PET (Polyethylene Terephthalate), COP (Cyclo Olefin Polymer), PCTFE (Polychlortrifluorethylene), EVA (Ethylene-vinyl acetate) or PEEK (Polyetheretherketone) these materials are all thermoformable materials with the requisite properties, for instance tensile strength, moisture barrier properties, and biocompatibility. The sub-shell is constructed of a polymer material or a ceramic-filled polymer material such as UV- or visible light cured acrylic resins which are already used for the generative/additive manufacturing of hearing aid shells. Alternatively, the sub-shell can also be made of a sintered thermoplastic polymer powder (e.g. PA12). These plastics are suitable for use with generative manufacturing methods, have the requisite stiffness and strength, and are biocompatible.

The object of the invention is likewise attained by a method of manufacturing a hearing device, comprising manufacturing a shell according to one of the above-mentioned methods, further comprising the step of assembling at least one further hearing device component into the shell, thereby applying the shell of the invention to a complete hearing device.

In an embodiment of the method of manufacturing a hearing device, the at least one further hearing device component comprises an electronic module, and the faceplate is furthermore assembled to the open end of the shell. The shell of the invention is thus built into an in-the-ear-type hearing device.

In an alternative embodiment of the method of manufacturing a hearing device, the further hearing device component comprises at least one of a receiver and a sound tube, incorporating the shell of the invention into a behind-the-ear hearing device.

BRIEF DESCRIPTION OF THE FIGURES

The invention will now be further elaborated by means of the attached figures, which show.

In the figures, like parts and like method steps are represented by like reference signs.

DETAILED DESCRIPTION OF THE INVENTION

Figure 1:
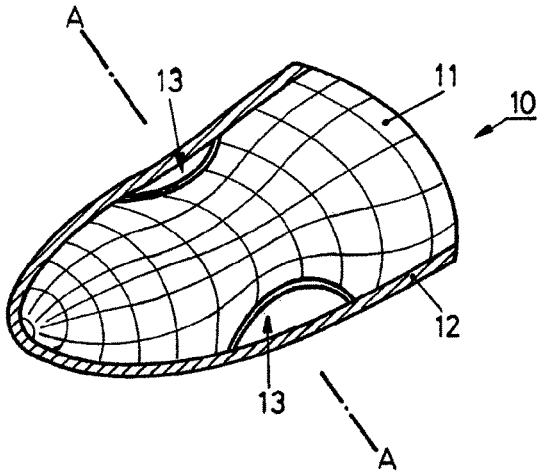
FIG. 1: A perspective schematic view of a shell according to a first embodiment of the invention with the hull partially cut away.

FIG. 1 illustrates a shell 10 for a hearing device according to a first embodiment of the invention, and comprises a closed end (in which ultimately at least one hole will be formed for a sound outlet and/or a wax guard) situated on the left-hand side of FIG. 1, and an open end situated on the right-hand side of FIG. 1. The shell comprises a sub-shell 11 situated inside a thermoformed hull 12. In the view of FIG. 1, the thermoformed hull 12 has been cut away so as to show the structure of the shell 10. Shell 10 may be a shell for an in-the-ear hearing device, particularly an Invisible In the Canal (iiC) hearing device, or may likewise be a shell of an earpiece for a behind-the-ear hearing device.

Sub-shell 11 is fabricated of a relatively rigid biocompatible material, such as a polymer material or a ceramic-filled polymer material such as UV- or visible light cuarble acrylic resins, and is responsible for the majority of the structural integrity and stiffness of the shell 10. As such, the wall thickness of the sub-shell 11 would typically be at least 0.4 mm to ensure this structural stability, however this value is not to be construed as limiting. Furthermore, sub-shell 11 comprises lateral openings 13 in the sides of the sub-shell 11, which will be described in greater detail below.

Thermoformed hull 12 is fabricated of a relatively flexible biocompatible thermoformable polymer film such as PE (Polyethylene), BAREX (Acrylonitrile/Methyl acrylate), PET (Polyethylene Terephthalate), COP (Cyclo Olefin Polymer), PCTFE (Polychlortrifluorethylene), EVA (Ethylene-vinyl acetate) or PEEK (Polyetheretherketone), and ideally has a wall thickness of less than 0.1 mm. Thicknesses as low as 20 μm are today possible. In consequence, the wall thickness of the complete shell is locally reduced to 0.1 mm or less, rendering the shell flexible in the region of lateral openings 13 and thus able to flex in response to changes in ear canal geometry without resulting in excess pressure being applied to the ear canal. The thermoformed hull 12 is furthermore responsible for acting as a barrier for preventing moisture, cerumen, dust, and so on from entering the interior of the shell 10.

Thermoformed hulls 12 are easily distinguishable from hulls or shells produced by other processing techniques such as injection moulding. Firstly, thermoforming enables the wall thickness of the thermoformed hull 30 to be significantly thinner (approximately 50-100 μm, or even 20-100 μm thickness) than those produced e.g. by injection moulding: injection moulded shells or hulls are typically 3 to 5 times thicker due limitations of the process. As a result, they are relatively rigid, and either exhibit visible seams and/or sprues, or must be created as two half-shells, such as that described in U.S. Pat. No. 7,092,543. Since the thermoformed hulls have significantly thinner walls than injection moulded hulls, or hulls produced by other methods, they are relatively elastic and flexible. Secondly, the orientation of the crystal structure of the plastic material is identifiably different in a thermoformed hull compared with an injection moulded hull. Despite the relatively thin wall thickness, thermoformed hulls retain very high tensile strength.

As was briefly stated above, sub-shell 11 comprises lateral openings 13 in the sides of the sub-shell 11, which are covered by the thermoformed hull 12 when the shell 10 is assembled. These openings 13 are provided in locations in the shell 10 which will be subject to pressure from the ear canal as it changes shape e.g. during jaw movement. These openings 13 are covered by the thermoformed hull 12 to prevent ingress of moisture, cerumen, dust etc. into the interior of the shell 10, and so as to render the area of each opening 13 more flexible than the remainder of the sub-shell 11. Essentially, the local stiffness of the shell 10 is the sum of the stiffness of the sub shell 11 and the stiffness of the thermoformed hull 12 at all points where sub-shell material is present, which prevents excessive longitudinal deformation of the shell 10, provides resistance to crushing, e.g. from mishandling, and protection from damage e.g. when dropped. In the region of the openings 13, the local stiffness of the shell 10 is only that of the thermoformed hull 12, which is flexible in comparison to the sub-shell 11. This locally reduced stiffness enables the shell 10 to easily deform in response to pressure in the area of the openings 13, thus allowing the shape of the shell 10 to adapt to movements of the ear canal of the wearer, reducing wearer discomfort. Furthermore, in the region of the openings 13 there is more volume available inside the shell 10 for hearing device components than there would be if the openings 13 were not present.

Figure 2:
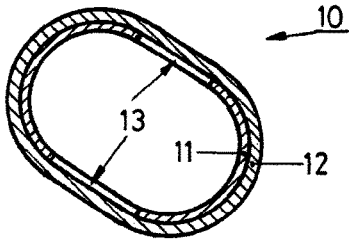
FIG. 2: A section on line A-A of FIG. 1

FIG. 2 illustrates a cross-section on line A-A of FIG. 1. On this figure, the arrangement of thermoformed hull 12 on the exterior surface of sub-shell 11 is clearly visible, as are openings 13, covered on their exterior side by thermoformed hull 12. Sub-shell 11 and thermoformed hull 12 may be joined by adhesive bonding, by welding (e.g. ultrasonically), or by being formed integrally with each other.

Figure 3:
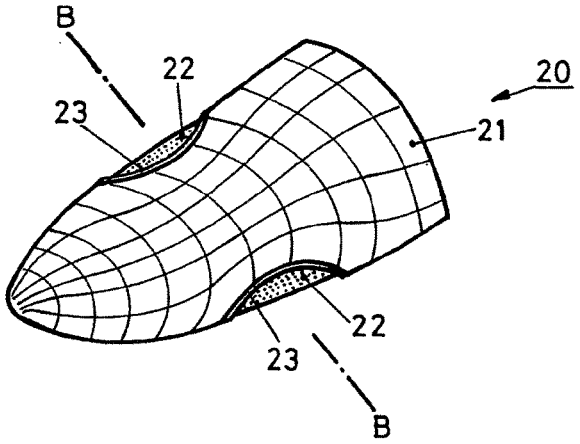
FIG. 3: A perspective schematic view of a shell according to a second embodiment of the invention.

FIG. 3 illustrates a second embodiment of a shell 20 for a hearing device according to the invention, which differs from the embodiment of FIGS. 1 and 2 in that the thermoformed hull 22 is situated on the interior of sub-shell 21. This arrangement provides even greater relief from pressure on the ear canal in the areas of openings 23, since the surface of thermoformed hull 22 is below the outer surface of sub-shell 21 by an amount equal to the wall thickness of the sub-shell 21. This, however, comes at the cost of reducing the space available for hearing device components on the interior of the shell 20 in the region of the openings 23.

Figure 4:
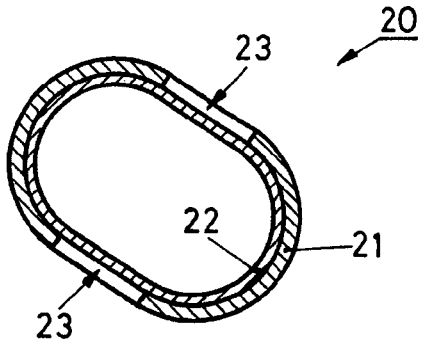
FIG. 4: A section on line B-B of FIG. 3.

FIG. 4, in analogy to FIG. 2, illustrates a cross-section of shell 20 along line B-B of FIG. 3, illustrating clearly the arrangement of sub-shell 21 and thermoformed hull 22 on the interior surface thereof. Openings 23 are clearly visible, covered on their interior side by thermoformed hull 22. The above-mentioned comments regarding the joining of sub-shell 11 and thermoformed hull 12 apply equally to sub-shell 21 and thermoformed hull 22 here.

Figure 5:
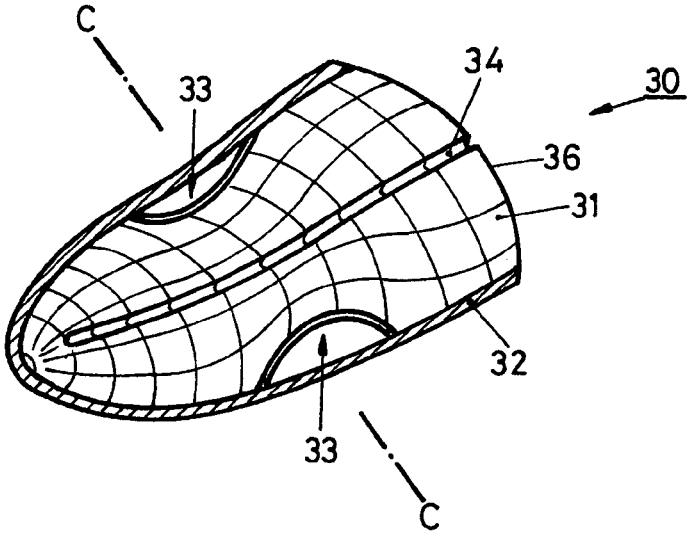
FIG. 5: A perspective schematic view of a shell according to a third embodiment of the invention with integrated vent tube, with the hull partially cut away.
Figure 6:
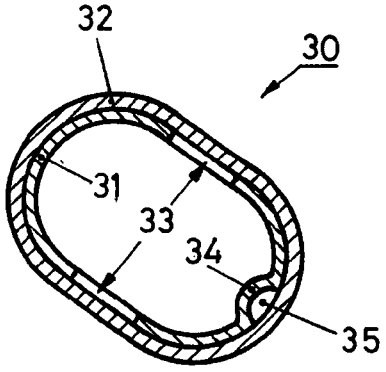
FIG. 6: A section on line C-C of FIG. 5.

FIGS. 5 and 6, in analogy to FIGS. 1 and 2, illustrate a third embodiment of a shell 30 for a hearing device according to the invention. In this embodiment, reference signs 30-33 correspond respectively to reference signs 10-13 of FIGS. 1 and 2. Shell 30 of the third embodiment differs from shell 10 of the first embodiment in that a groove 34 is formed in sub-shell 31 which, together with thermoformed hull 32 constitutes a vent tube 35, which may have a cross-sectional form similar to those described in U.S. Pat. No. 6,533,062, herein incorporated by reference in its entirety. Each end of the vent tube 34 is open to the ambient conditions, e.g. via a corresponding opening in thermoformed hull 32, or via opening at the end face 36 of shell 30.

Figure 7:
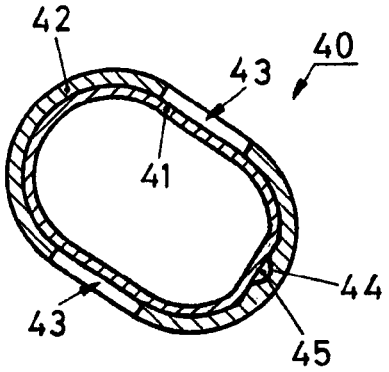
FIG. 7: A cross-section corresponding to that of FIG. 4 with integrated vent tube.

It is naturally also foreseeable to incorporate a vent tube of this type into the second embodiment of FIGS. 3 and 4 in exactly the same manner, as is illustrated in the cross-sectional view of FIG. 7 corresponding to that of FIG. 4. In FIG. 7, reference signs 40-43 correspond respectively to reference signs 20-23 of FIG. 4, and the embodiment of FIG. 7 differs from that of FIGS. 3 and 4 in that a groove 44 is provided in the interior surface of sub-shell 42 which, together with thermoformed hull 41 constitutes a vent tube 45. Likewise as above, each end of the vent tube 44 is open to the ambient conditions, e.g. via a corresponding opening in sub-shell 41, or via an opening at the end face of shell 40 (not illustrated).

As previously discussed, any of the shells 10, 20, 30, 40, can form at least part of the enclosure of an in-the-ear hearing device, or at least part of an earpiece for a behind-the-ear hearing device. In the former case, the hearing device itself is at least partially disposed within the shell, and in the latter case, the shell is connected to the main body of the hearing device either via a sound tube in the case in which the receiver (loudspeaker) is situated in the behind-the-ear unit, or via an electrical wire in the case in which the receiver (loudspeaker) is situated in the shell rather than in the behind-the-ear unit.

Figure 8:
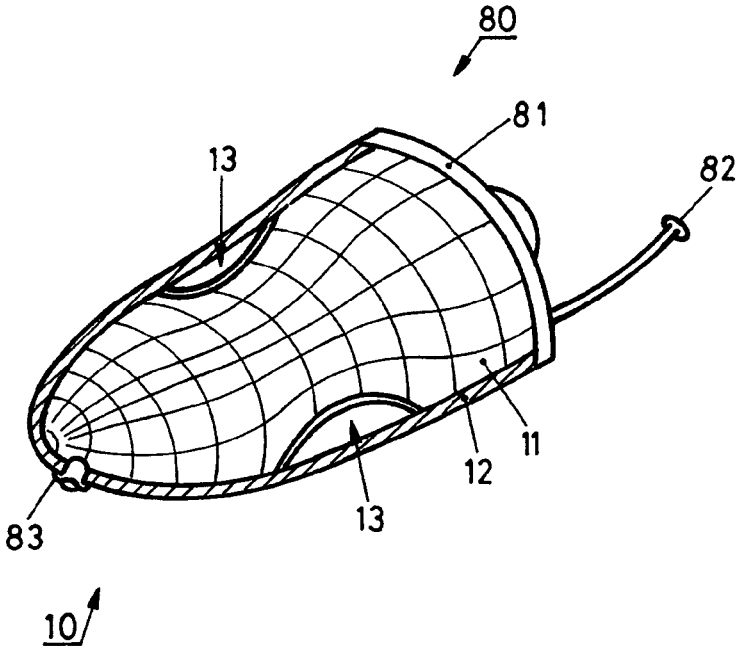
FIG. 8: A perspective schematic view of a hearing device comprising a shell according to the first embodiment of the invention with the hull partially cut away.

FIG. 8 illustrates an in-the-ear, specifically an in-the-canal hearing device 80 comprising a shell 10 of the first embodiment, as described above. Inside the shell 10 is disposed an electronics module (not illustrated), and on the open end of shell 10 the faceplate 81 is provided as is conventional. Faceplate 81 may carry the electronic components of the electronics module (not illustrated), and also may comprise a battery compartment (not illustrated) and a removal filament 82. Sound outlet 83 is provided as is conventional and as is convenient at the end of the shell 10 opposite the faceplate 81, i.e. in the substantially-closed end of the shell, and may further comprise a wax guard as is conventional.

A hearing device so constructed presents several options for applying serial numbers. The serial number may be engraved e.g. by laser on the sub-shell, visible through the thermoformed hull, or on the thermoformed hull itself, with or without application of coloured lacquer.

Figure 9:
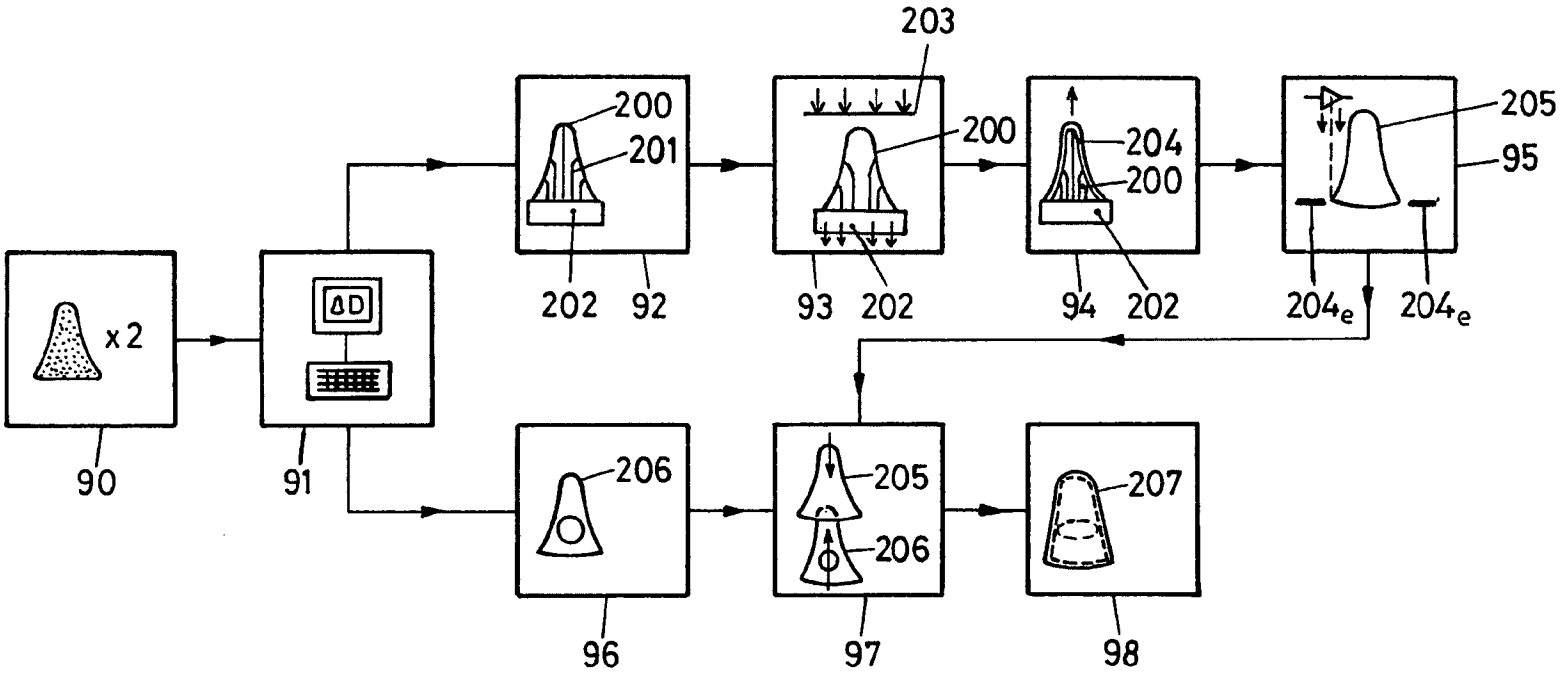
FIG. 9: a schematic illustration of a first embodiment of a method according to the invention.

FIG. 9 illustrates schematically a first embodiment of a method for manufacturing a shell for a hearing device corresponding to that of FIGS. 1, 2, 5 and 6.

Firstly, in step 90, at least two measurements are made of a patient's ear canal at different jaw opening positions so as to ascertain the shape of the ear canal during natural movements. This can be performed by means of one or more of the following techniques:

- taking at least two conventional impressions of the ear canal, for instance with the patient's jaw fully closed and fully open, and then scanning the impressions;
- taking an impression of the ear canal using a material that, after hardening, changes colour depending on pressure. The shape of the impression thus constitutes the first measurement. Once the impression has hardened, the individual moves his or her jaw, e.g. by talking or chewing, or by moving it through its greatest extent. The colour changes thus measure the pressure exerted by changes in the shape of the ear canal, and constitute a second measurement. Scanning the impression and recording the colour changes thus provide information on the shape of the ear canal and its changes.
- directly scanning the shape of the ear canal in real-time by means of an in-ear scanner to record its dynamic movements.

Once the at least two measurements have been made, in step 91, the gathered data are then used to model the optimal form of the sub-shell and the thermoformed hull which will together constitute the shell. This modelling takes into account the structural stiffness required, as well as the position and size of openings in the sub-shell to compensate for changes in the shape of the ear canal during jaw movement. Any further features such as a groove for a vent tube such as that illustrated in FIGS. 4 and 5, fixation features for electronic and/or electroacoustic components, and so on, are incorporated into the model at this point. In addition, the material thickness is taken into account in determining the modelled shapes. On the basis of the model, component placement may also be determined at this stage.

Following now along the upper track of FIG. 9, in step 92, a thermoforming die 200 is fabricated based on the modelled shape of the thermoformed hull, again taking the material thickness into consideration. Thermoforming die 200 in this embodiment is a male-type mould conforming to the inner contour of thermoformed hull 205, and is fabricated by a generative manufacturing method, such as a rapid prototyping method e.g. laser sintering, laser lithography, stereolithography or a thermojet process. These processes are known per se and thus need not be discussed further. Alternatively, a female-type mould conforming to the outer contour of thermoformed hull 205 may be used. A plurality of air channels 201 may be provided if required to permit a vacuum applied via a baseplate 202 to be transmitted to the polymer film material as it is thermoformed. Alternatively, these discreet, individual passages may be replaced by fabricating thermoforming die 202 from a porous material, which permits the passage of air, e.g. a porous sintered material.

In step 93, polymer film 203, which may be of a material such as PE, BAREX, PET, COP PCTFE, EVA or PEEK, and may have a wall thickness of less than 0.1 mm, is vacuum thermoformed over thermoforming mould 200, with the assistance of a vacuum applied via baseplate 202, as is conventional and thus need not be described further. Subsequently, in step 94 the now thermoformed polymer film 204, having taken the shape of the thermoforming die 200, is removed from the thermoforming die 200, e.g. by applying a positive pressure via baseplate 202, or simply by pulling the thermoformed polymer film 204 from the die, as is conventional. In step 95, the thermoformed hull 205 is liberated from the excess thermoformed polymer film $\mathbf{204}_e$, e.g. by laser cutting, hot wire cutting, or mechanical cutting such as with an ultrasonic knife. Advantageously, this cutting may take place in the plane of the faceplate. At this stage, if desired, holes for e.g. a sound outlet, wax guard etc may be formed in the thermoformed hull 205 by e.g. laser cutting, either before, during, or after liberation of the thermoformed hull 205 from the remainder of the thermoformed polymer film.

Following now the lower track of FIG. 9, in step 96 sub-shell 206 is fabricated, based on its modelled shape as determined in step 91, by a generative manufacturing method such as a rapid prototyping method e.g. laser sintering, laser lithography, stereolithography or a thermojet method.

Once both the thermoformed hull 205 and the sub-shell 206 have been fabricated, the sub-shell 206 is inserted into thermoformed hull 205, and they are bonded together. This bonding can take place by any known method, such as by applying adhesive to one or more of the thermoformed hull 205 and the sub-shell 206, or by welding, e.g. ultrasonic welding.

The shell 207 is thus in principle completed in step 98, and any required holes for e.g. a sound outlet, wax guard etc. if desired can be drilled at this stage, either mechanically or by laser cutting.

The shell is then ready to be assembled into a completed hearing device, i.e. in the case of an in-the-ear hearing device, the electronics module and faceplate can be assembled to the shell, or in the case of a behind-the-ear hearing device, a sound tube, or a loudspeaker and electric cable can be assembled into the shell. This applies equally to the completed shells of any of the below embodiments.

Figure 10:
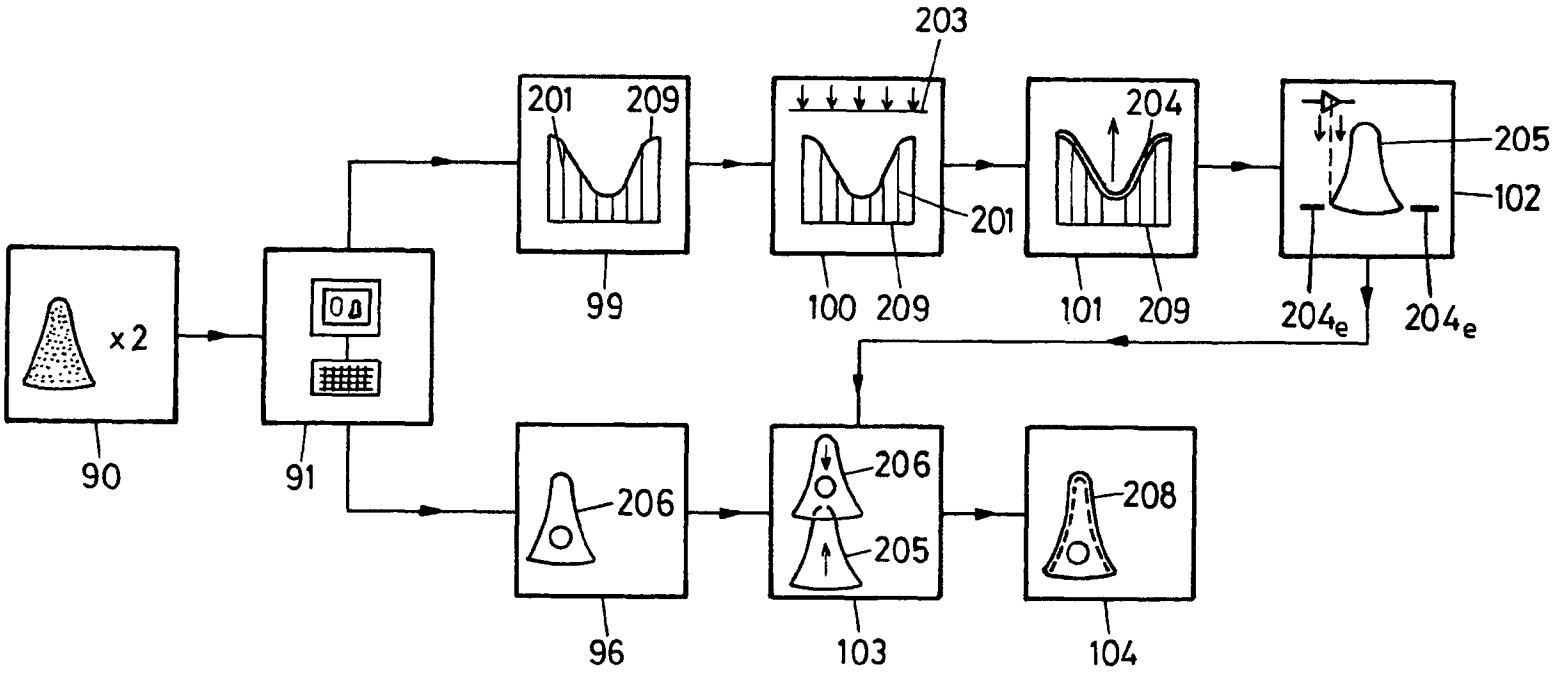
FIG. 10: a schematic illustration of a second embodiment of a method according to the invention.

FIG. 10 illustrates a second embodiment for manufacturing a shell corresponding to that of FIGS. 3, 4 and 7. Essentially, this method differs from that of FIG. 9 in that it is intended to produce a shell in which the sub-shell 206 is situated outside of the thermoformed hull 205 when the completed shell 208 is assembled.

Steps 90, 91 and 96 are identical to those of FIG. 9, with the exception that the modelling takes into account the opposite arrangement of the thermoformed hull 205 and the sub-shell 206 in the completed shell 208.

However, following the upper path of FIG. 10, in step 99, the thermoforming mould 209 is, in contrast to that of FIG. 9, constructed as a female-type mould, conforming to the desired outer contour of thermoformed hull 205. Alternatively, a male-type mould conforming to the desired inner contour of the thermoformed hull 205 may be used, taking into account the thickness of the material. As in FIG. 9, a plurality of air channels 201 may be formed in the thermoforming mould 209, or alternatively the thermoforming mould 209 may be fabricated of a porous material. In step 100, a sheet of polymer film 203 is thermoformed into thermoforming die 209 with the assistance of either vacuum pressure applied through air channels 201, or by positive pressure from the free-side of the polymer film 203. Subsequently, in step 101, the thermoformed polymer film 204 is removed from thermoforming die 209 in analogy to step 94 above, and in step 102 the thermoformed hull 205 is liberated from the excess thermoformed polymer film $\mathbf{204}_e$ in analogy to step 95 above. As above, any required holes may likewise be formed in thermoformed hull 205 at this stage, either before, during, or after liberation of the thermoformed hull 205 from the thermoformed polymer film.

Following now the lower track of FIG. 10, as has previously been stated, step 96 is analogous to that of FIG. 9. In step 103, the thermoformed hull 205 is assembled on the interior of sub-shell 206 in analogy to step 97 above with the position of the thermoformed hull 205 and sub-shell 206 reversed. Finally, in step 104 the shell is thus in principle completed, and any required holes for e.g. a sound outlet, wax guard etc. if desired can be drilled at this stage, either mechanically or by laser cutting.

The shell is then ready to be assembled into a completed hearing device as described above.

Figure 11:
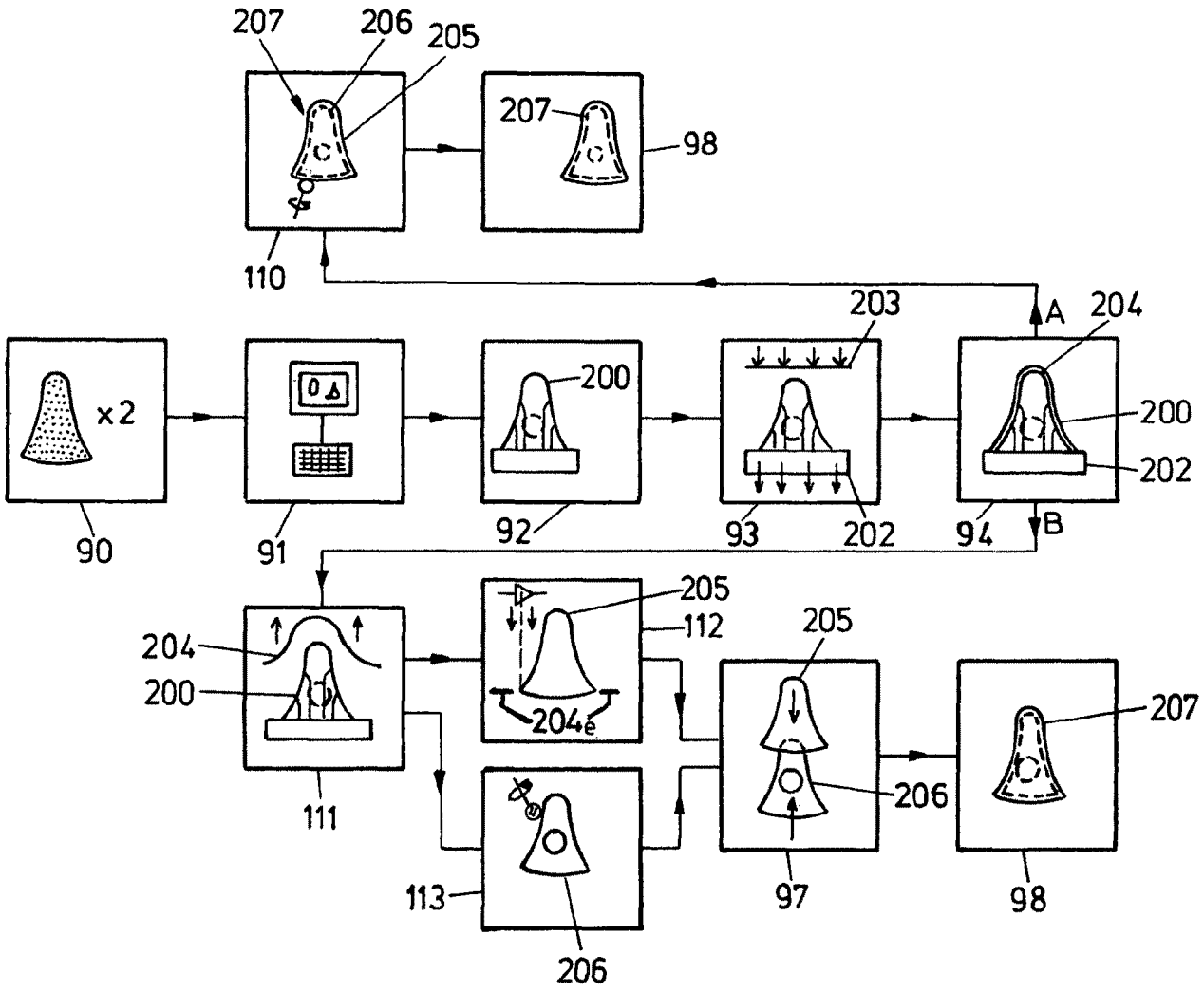
FIG. 11: a schematic illustration of a third and fourth embodiment of a method according to the invention.

FIG. 11 illustrates a third and fourth embodiment of manufacturing a shell as illustrated in FIGS. 1, 2, 5 and 6, which differ from the foregoing embodiments in that the thermoforming mould itself is modified into the sub-shell after thermoforming. Since both of these methods have a significant number of steps in common, they have been represented on a single figure. The upper track, labeled A, represents the third embodiment, and the lower track, labeled B represents the fourth embodiment.

Dealing first with the steps common to both the third and the fourth embodiments, steps 90-94 are the same as those of FIG. 9, with the exception that, if desired, in step 91, the modelling may incorporate modelling weakened sections of thermoforming mould 200, defining easily removable sections and/or windows of thermoforming mould 200 that will ultimately not form part of the sub-shell 206 and can be broken away from the sub-shell. These weaker sections are thus incorporated into thermoforming mould 200 during its fabrication in step 92.

The third embodiment of the method is represented by the upper track, labelled "A", on FIG. 11. After the step of thermoforming the polymer film 203 to create the thermoformed polymer film 204, the thermoformed polymer film is attached to the thermoforming mould 200, e.g. by ultrasonic welding. Alternatively, an adhesive may be applied to the polymer film 203 and/or to the thermoforming mould 200 before thermoforming. Subsequently, in step 110, the thermoforming mould 200 has any easily removable sections broken out of it, and is machined as necessary so as to fabricate the sub-shell 206 in situ in the thermoformed hull 205, and the shell is then finished in step 98 as in FIG. 9, and is ready to be assembled into part of a hearing device. This has the advantage that the thermoformed hull 205 is formed in intimate contact with what will become the sub-shell 206, thus improving the matching accuracy of the sub-shell 206 and the thermoformed hull 205. Furthermore, no additional die or sub-shell is required.

Turning now to the fourth embodiment of the method as represented by the lower track, labelled "B" on FIG. 11, after step 94, in step 111, the thermoformed polymer film 204 is separated from thermoforming die 200, and in step 112 the thermoformed hull is liberated from the excess thermoformed polymer film $\mathbf{204}_e$ as in step 95 of FIG. 9. In step 113, the thermoforming mould 200 has any removable sections broken out of it, and is machined so as to form the sub-shell 206. The thermoformed hull 205 and the sub-shell 206 are then assembled and finished in steps 97 and 98 as in FIG. 9, and the shell 207 is then ready to be assembled into at least part of a hearing device. The advantage of this method over that of the third embodiment is that finishing of the sub-shell 206 is simplified by it having been separated from the thermoformed hull 205, allowing greater access to machining tools.

It should be noted that, although the third and fourth embodiments illustrated in FIG. 11 relate to manufacturing the shell of the embodiments of FIGS. 1, 2, 5 and 6 in which the sub-shell is situated inside the thermoformed hull, it is equally applicable to the manufacturer of the shell of the embodiments of FIGS. 3, 4 and 7, by forming the thermoforming die as a "female"-type die as illustrated in FIG. 10, and then removing removable sections and machining this thermoforming die to form a sub-shell situated on the outside of the thermoformed hull.

Figure 12:
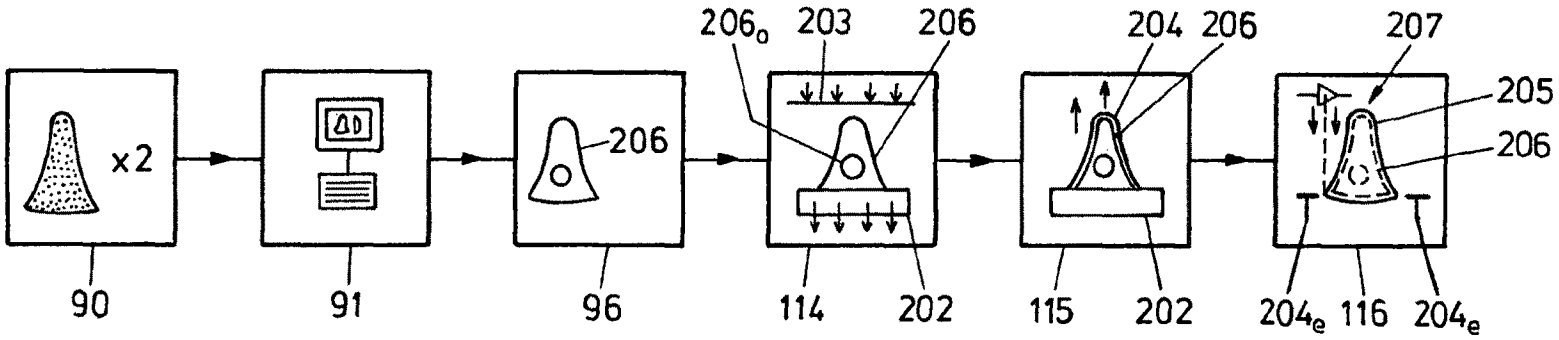
FIG. 12: a schematic illustration of a fifth embodiment of a method according to the invention.

FIG. 12 illustrates a fourth embodiment of a method of manufacturing a shell according to the invention, which differs from the foregoing in that the sub-shell is utilised as the thermoforming die.

Steps 90, 91 and 96 are the same as in the embodiment of FIG. 9, with the exception that the sub-shell 206 may comprise air channels, or may be porous as required to prevent air bubbles being trapped between subshell 206 and thermoformed hull 205 during thermoforming. In step 114, the sub-shell 206 is placed on a base plate 202. If required to prevent the thermoformed polymer film from being suctioned into the openings $\mathbf{206}_o$ of the sub-shell 206, a support, packing material or similar may be placed inside the sub-shell 206. A vacuum is applied via the base plate 202, and the polymer film 203 is thermoformed onto the sub-shell 206. To attach the thermoformed polymer film 204 to the sub-shell 206, ultrasonic welding may be applied, or adhesive may have been applied previously to one or more of the polymer film 203 and the sub-shell 206. This may occur as convenient in step 114, 115, or 116.

In step 115, the thermoformed polymer film 204 is removed from the base plate 202 together with the sub-shell 206, and in step 116, the excess thermoformed film $\mathbf{204}_e$ is removed by e.g. laser cutting, hot wire cutting, or mechanical cutting such as with an ultrasonic knife. The shell 207 can then be finished as in previous embodiments, and is ready to be assembled into at least part of a hearing device.

Although the foregoing embodiments illustrate the manufacture of the shell in terms of custom shell design fitted to one individual, the invention is equally applicable to off-the-shelf standard shells. In such a case, steps 90 and 91 are omitted, and previously-defined standard sub-shells 206 and standard thermoformed hulls 205 are produced. Defining standard shells can for instance be carried out by taking the measurements of step 90 of a large number of individuals, and mathematically defining "best fit" shell models.

Furthermore, application of a serial number to the shell, either on the sub-shell or the thermoformed hull, may be carried out at any convenient point in any of the above-mentioned methods.

Although the invention has been described in terms of specific embodiments, these are not be construed as limiting to the invention, which is solely defined by the scope of the appended claims.

The invention claimed is:

1. An auditory device for use in an ear canal having a region that changes shape in response to jaw movement, the device comprising:

a shell including a sub-shell formed from a rigid biocompatible material and having at least two lateral openings on substantially opposite sides of the sub-shell, and a thermoformed hull covering the at least two lateral openings of the sub-shell, wherein the shell is configured such that, when the shell is within the ear canal, the ear canal region that changes shape in response to jaw movement will exert pressure on the at least two lateral openings; and a hearing device component located within the shell.

2. An auditory device as claimed in claim 1, wherein the hearing device component includes one or more of a hearing device electronics module, a receiver and a sound tube.

3. An auditory device as claimed in claim 1, wherein the sub-shell is more rigid than the thermoformed hull.

4. An auditory device as claimed in claim 1, further comprising:

a vent channel formed between the thermoformed hull and a groove in the sub-shell.

5. An auditory device as claimed in claim 1, wherein the thermoformed hull defines an interior surface and the sub-shell is situated on the interior surface of the thermoformed hull.

6. An auditory device as claimed in claim 1, wherein the thermoformed hull is formed from a material selected from the group consisting of PE, BAREX, PET, COP, EVA, PCTFE, and PEEK; and the rigid biocompatible material is selected from the group consisting of a polymer and a ceramic-filled polymer.

7. An auditory device as claimed in claim 1, wherein the shell defines a thickness that ranges from 0.1 millimeters to 20 micrometers in regions adjacent to the at least two lateral openings and a total thickness of at least 0.4 millimeters in the remainder of the shell.

8. An auditory device for use in an ear canal having a region that changes shape in response to jaw movement, the device comprising:

a shell defining a shell stiffness and including a sub-shell defining an interior cavity and longitudinal ends, and a thermoformed hull covering the sub-shell;

means for reducing the stiffness, as compared to the remainder of the shell, of two lateral portions of the shell that are located between the longitudinal ends of the sub-shell and on substantially opposite sides of the shell, without reducing the stiffness of the shell at other locations between the longitudinal ends of the sub-shell, such that the two lateral portions will flex relative to the remainder of the shell, in response to pressure exerted onto the two lateral portions as a result of jaw movement; and a hearing device component located within the shell.

9. An auditory device as claimed in claim 8, wherein the hearing device component includes one or more of a hearing device electronics module, a receiver and a sound tube.

10. An auditory device as claimed in claim 8, wherein the sub-shell is more rigid than the thermoformed hull.

11. An auditory device as claimed in claim 8, further comprising:

a vent channel formed between the thermoformed hull and a groove in the sub-shell.

12. An auditory device as claimed in claim 8, wherein the thermoformed hull defines an interior surface and the sub-shell is situated on the interior surface of the thermoformed hull.

13. An auditory device as claimed in claim 8, wherein the thermoformed hull is formed from a material selected from the group consisting of PE, BAREX, PET, COP, EVA, PCTFE, and PEEK; and the sub-shell is formed from a material selected from the group consisting of a polymer and a ceramic-filled polymer.

14. An auditory device as claimed in claim 8, wherein the shell defines a thickness that ranges from 0.1 millimeters to 20 micrometers in regions adjacent to the at least two lateral openings and a total thickness of at least 0.4 millimeters in the remainder of the shell.

15. A method, comprising the step of:

placing an auditory device, which includes a shell with a sub-shell formed from a rigid biocompatible material and having at least two lateral openings on substantially opposite sides of the sub-shell and a thermoformed hull covering the at least two lateral openings of the sub-shell, and a hearing device component located within the shell, within a patient's ear canal such that the at least two lateral openings are within an ear canal region that changes shape in response to jaw movement and will exert pressure on the shell at the at least two lateral openings.

16. A method as claimed in claim 15, further comprising the step of:

prior to the step of placing the auditory device into the patient's ear canal, ascertaining the shape of the patient's ear canal during jaw movements by taking at least two measurements of the ear canal at different jaw open positions.

17. A method as claimed in claim 16, further comprising the step of:

after ascertaining the shape of the patient's ear canal during jaw movements, modelling a shape, a size, and a stiffness of the shell and locations of the at least two lateral openings based on the ascertained the shape of the patient's ear canal during jaw movements.

18. A method as claimed in claim 15, wherein the hearing device component includes one or more of a hearing device electronics module, a receiver and a sound tube.

19. A method as claimed in claim 15, wherein the sub-shell is more rigid than the thermoformed hull.

20. A method as claimed in claim 15, wherein the auditory device includes a vent channel formed between the thermoformed hull and a groove in the sub-shell.

21. A method as claimed in claim 15, wherein the thermoformed hull defines an interior surface and the sub-shell is situated on the interior surface of the thermoformed hull.

* * * * *